US011189959B2

(12) United States Patent
Hara

(10) Patent No.: US 11,189,959 B2
(45) Date of Patent: Nov. 30, 2021

(54) WATERPROOF CONNECTOR

(71) Applicant: Sumitomo Wiring Systems, Ltd., Mie (JP)

(72) Inventor: Teruo Hara, Mie (JP)

(73) Assignee: Sumitomo Wiring Systems, Ltd.

( * ) Notice: Subject to any disclaimer, the term of this patent is extended or adjusted under 35 U.S.C. 154(b) by 700 days.

(21) Appl. No.: 16/076,058

(22) PCT Filed: Jan. 23, 2017

(86) PCT No.: PCT/JP2017/002062
§ 371 (c)(1),
(2) Date: Aug. 7, 2018

(87) PCT Pub. No.: WO2017/138335
PCT Pub. Date: Aug. 17, 2017

(65) Prior Publication Data

US 2021/0218181 A1 Jul. 15, 2021

(30) Foreign Application Priority Data

Feb. 12, 2016 (JP) ..... JP2016-024497

(51) Int. Cl.
*H01R 13/40* (2006.01)
*H01R 13/52* (2006.01)
(Continued)

(52) U.S. Cl.
CPC ..... *H01R 13/5208* (2013.01); *H01R 13/11* (2013.01); *H01R 13/504* (2013.01); *H01R 13/5219* (2013.01)

(58) Field of Classification Search
CPC .... H01R 13/11; H01R 13/504; H01R 13/587; H01R 13/5208; H01R 13/5219
(Continued)

(56) References Cited

U.S. PATENT DOCUMENTS 5,540,450 A * 7/1996 Hayashi ..... H01R 13/5205 174/152 G
6,250,962 B1 * 6/2001 Shinozaki ..... H01R 13/5208 439/275
(Continued)

FOREIGN PATENT DOCUMENTS

JP 2011-18551 1/2011
JP 2013-54899 3/2013
(Continued)

OTHER PUBLICATIONS

International Search Report dated Mar. 21, 2017.

*Primary Examiner* — Abdullah A Riyami
*Assistant Examiner* — Vladimir Imas
(74) *Attorney, Agent, or Firm* — Gerald E. Hespos; Michael J. Porco; Matthew T. Hespos

(57) ABSTRACT

A waterproof connector (C) includes a wire (W) having a terminal (10) connected thereto, a housing (20) formed with a cavity (24) capable of accommodating the terminal (10), and a rubber plug (30) formed with a through hole (32) in correspondence with the cavity (24) and disposed on a rear surface of the housing (20). The rubber plug (30) includes the through hole (32), the wire (W) being inserted through the through hole, front and rear inner peripheral lips (33, 34) to be held in close contact with an outer peripheral surface of the wire (W) are provided on an inner wall of the through hole (32). A center of the front inner peripheral lip (33) and a center of the rear inner peripheral lip (34) are displaced in a direction intersecting an inserting direction of the wire (W).

4 Claims, 15 Drawing Sheets

(51) Int. Cl.
*H01R 13/11* (2006.01)
*H01R 13/504* (2006.01)

(58) Field of Classification Search
USPC ..... 439/587
See application file for complete search history.

(56) References Cited

U.S. PATENT DOCUMENTS

| | | | | |
|---|---|---|---|---|
| 6,290,554 | B1 * | 9/2001 | Makita | H01R 13/11 439/852 |
| 7,033,216 | B2 * | 4/2006 | Ito | H01R 13/5208 439/275 |
| 8,215,987 | B2 * | 7/2012 | Yoshioka | H01R 13/4362 439/587 |
| 8,267,720 | B2 * | 9/2012 | Ishida | H01R 13/5208 439/587 |
| 8,734,174 | B2 * | 5/2014 | Nakamura | H01R 43/18 439/271 |
| 9,577,369 | B2 * | 2/2017 | Suzuki | H01R 13/506 |
| 9,859,648 | B2 * | 1/2018 | Hara | H01R 13/4367 |
| 10,205,269 | B2 * | 2/2019 | Hirota | H01R 13/4223 |
| 2013/0052864 | A1 * | 2/2013 | Kataoka | H01R 13/5208 439/587 |

FOREIGN PATENT DOCUMENTS

| | | |
|---|---|---|
| JP | 2013-171704 | 9/2013 |
| JP | 2015-69785 | 4/2015 |

* cited by examiner

WATERPROOF CONNECTOR

BACKGROUND

Field of the Invention

This specification relates to a waterproof connector.

Related Art

Japanese Unexamined Patent Publication No. 2013-171704 discloses a resilient sealing member for sealing the inside of a connector housing. This resilient sealing member is made of a resilient material, such as a rubber material, and includes a sealing body having terminal insertion holes. Terminals with wires are inserted respectively through the terminal insertion holes. A tubular wire close-contact portion is provided inside each terminal insertion hole, and each tubular wire close-contact portion has two arcuate close-contact portions to be held in close contact with the outer peripheral surface of the wire. The two arcuate close-contact portions in each terminal insertion hole are arranged side-by-side in an axial direction and are supported by a resilient support. Thus, one arcuate close-contact portion is disposed on each of both sides before and after the resilient support. If the wire is shaken, each arcuate close-contact portion is displaced resiliently in a seesaw manner with the resilient support as a center, thereby following a movement of the wire.

The resilient sealing member of Japanese Unexamined Patent Publication No. 2013-171704 is such that the two arcuate close-contact portions of each terminal insertion hole are coupled to an inner wall of the terminal insertion hole via the resilient supporting portion. Thus, sealing performance may be reduced due to a crack in the resilient supporting portion caused, such as, by the tip of the terminal butting against the resilient supporting portion when the terminal with wire is inserted into the terminal insertion hole.

SUMMARY

A waterproof connector disclosed by this specification has a wire with a terminal connected thereto, a housing formed with a cavity capable of accommodating the terminal, and a rubber plug disposed on a rear surface of the housing. The rubber plug is formed with a through hole in correspondence with the cavity and the wire is inserted through the through hole. Front and rear inner peripheral lips are provided on an inner wall of the through hole and are to be held in close contact with an outer peripheral surface of the wire. A center of the front inner peripheral lip and a center of the rear inner peripheral lip are displaced in a direction intersecting an inserting direction of the wire. According to this configuration, even if the wire is shaken, either one of the inner peripheral lips is certainly held in close contact with the outer peripheral surface of the wire. Thus, sealing performance can be exhibited. Specifically, the inner peripheral lips are provided at positions to be held in close contact with the outer peripheral surface of the wire if the wire is shaken. Thus, squeezed amounts of the inner peripheral lips by the outer peripheral surface of the wire are not reduced and sufficient sealing performance is maintained.

An intermediate lip including a step may be provided between the front and rear inner peripheral lips. The step may be provided between a front horizontal surface extending rearward from a rear end of the front inner peripheral lip and a rear horizontal surface extending forward from a front end of the rear inner peripheral lip. According to this configuration, sealing performance also can be exhibited by the intermediate lip. For example, the squeezed amounts of the front and rear inner peripheral lips are possibly smaller in a state where the wire is not shaken than in a state where the wire is shaken. Also, in that case, sealing performance can be maintained by the intermediate lip.

Further, if a center of a front inner peripheral lip and that of a rear inner peripheral lip match, a deepest part of a groove is at positions of mating surfaces and acute-angled corners are formed when front and rear molds are divided at the deepest part of the groove between the front and rear inner peripheral lips. Thus, the molds become easily fractured at the positions of the mating surfaces. However, according to the above-described configuration, the intermediate lip including the step is provided between the front and rear inner peripheral lips and the horizontal surfaces are provided before and after the step. Thus, if the positions of the steps are set on the mating surfaces, a corner part between a mold part for molding the horizontal surface and a mold part for molding the step is substantially right-angled. Therefore, the molds are less likely to be fractured at the positions of the mating surfaces.

The front and rear horizontal surfaces may be parallel to each other and perpendicular to the step. According to this configuration, since corner parts located on the mating surfaces of the molds are right-angled, the fracture of the molds can be prevented more reliably.

According to the waterproof connector disclosed by this specification, it is possible to maintain sufficient sealing performance even if the wire is shaken.

DETAILED DESCRIPTION

Figure 11:
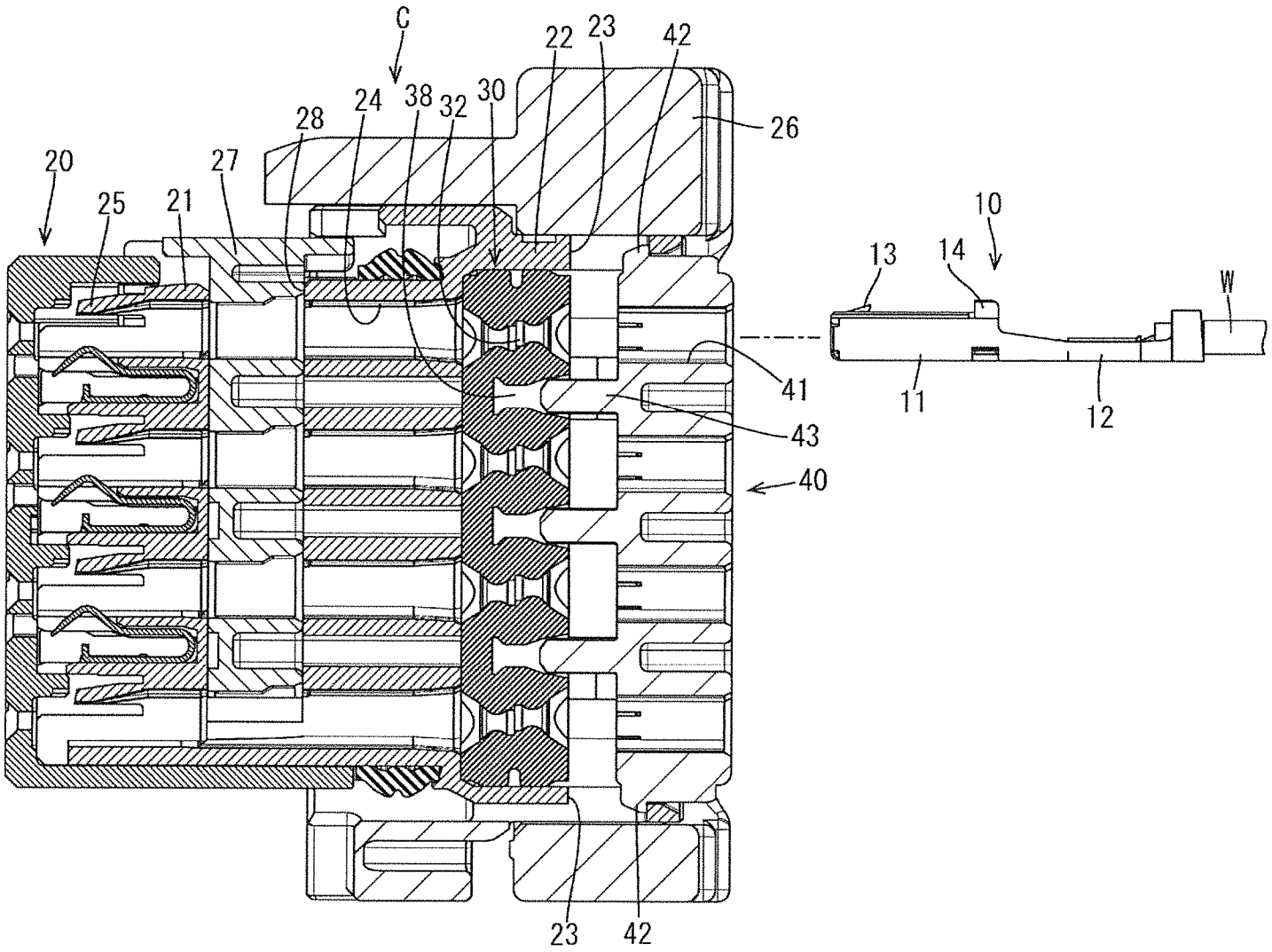
FIG. 11 is a section along A-A in FIG. 2 showing a state before a female terminal is inserted.
Figure 12:
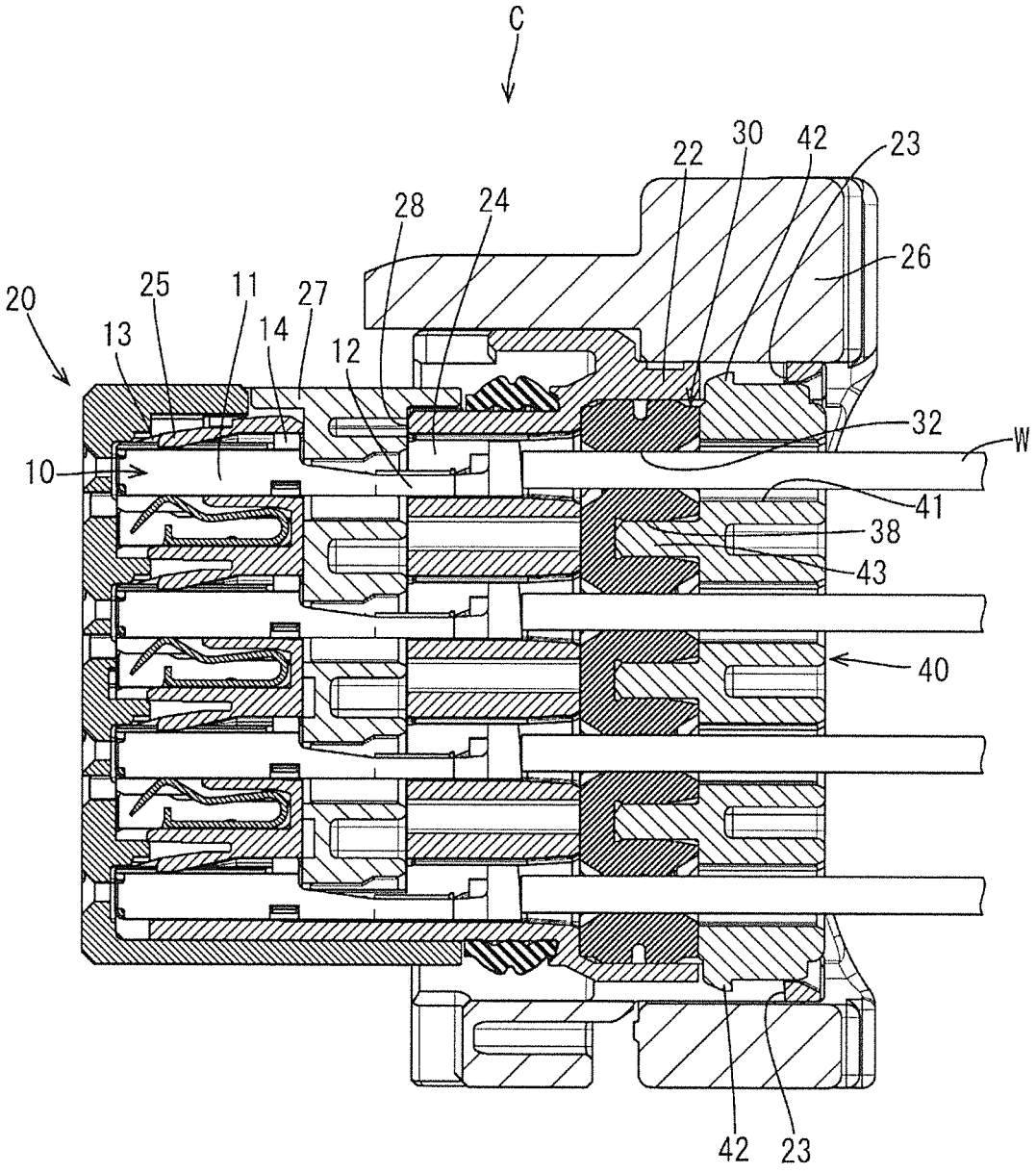
FIG. 12 is a section showing a state where the female terminal is inserted from the state of FIG. 11.

An embodiment is described with reference to FIGS. 1 to 15. As shown in FIG. 12, a waterproof connector C includes female terminals 10 connected to ends of wires W, and a female housing 20 formed with cavities 24 capable of accommodating the female terminals 10. A one-piece rubber plug 30 is disposed on the rear surface of the female housing 20 and is formed with through holes 32 in correspondence with the respective cavities 24. A rear holder 40 is formed with insertion holes 41 in correspondence with the respective through holes 32 and is configured to retain the one-piece rubber plug 30 from behind. A lever 26 is mounted on the female housing 20 for assisting a connection force between the female housing 20 and a mating male housing (not shown).

Each female terminal 10 is formed by press-working a metal plate excellent in conductivity. More particularly, each female terminal has a rectangular tubular body 11 and a barrel 12 provided behind the body 11, as shown in FIG. 12. The barrel 12 is connected to the end of the wire W by caulking the barrel 12. A tab of a mating male terminal (not shown) is insertable into the body 11 from the front, and a resilient contact piece (not shown) is provided in the body 11 for resiliently contacting the tab.

A locking protrusion 13 projects at a position near a front end on the upper surface of the body 11 of the female terminal 10 and is to be locked to a locking lance 25 provided at an inner wall of the cavity 24. Further, a stabilizer 14 for preventing inverted insertion of the female terminal 10 projects up at a rear end position on the upper surface of the body 11.

Figure 1:
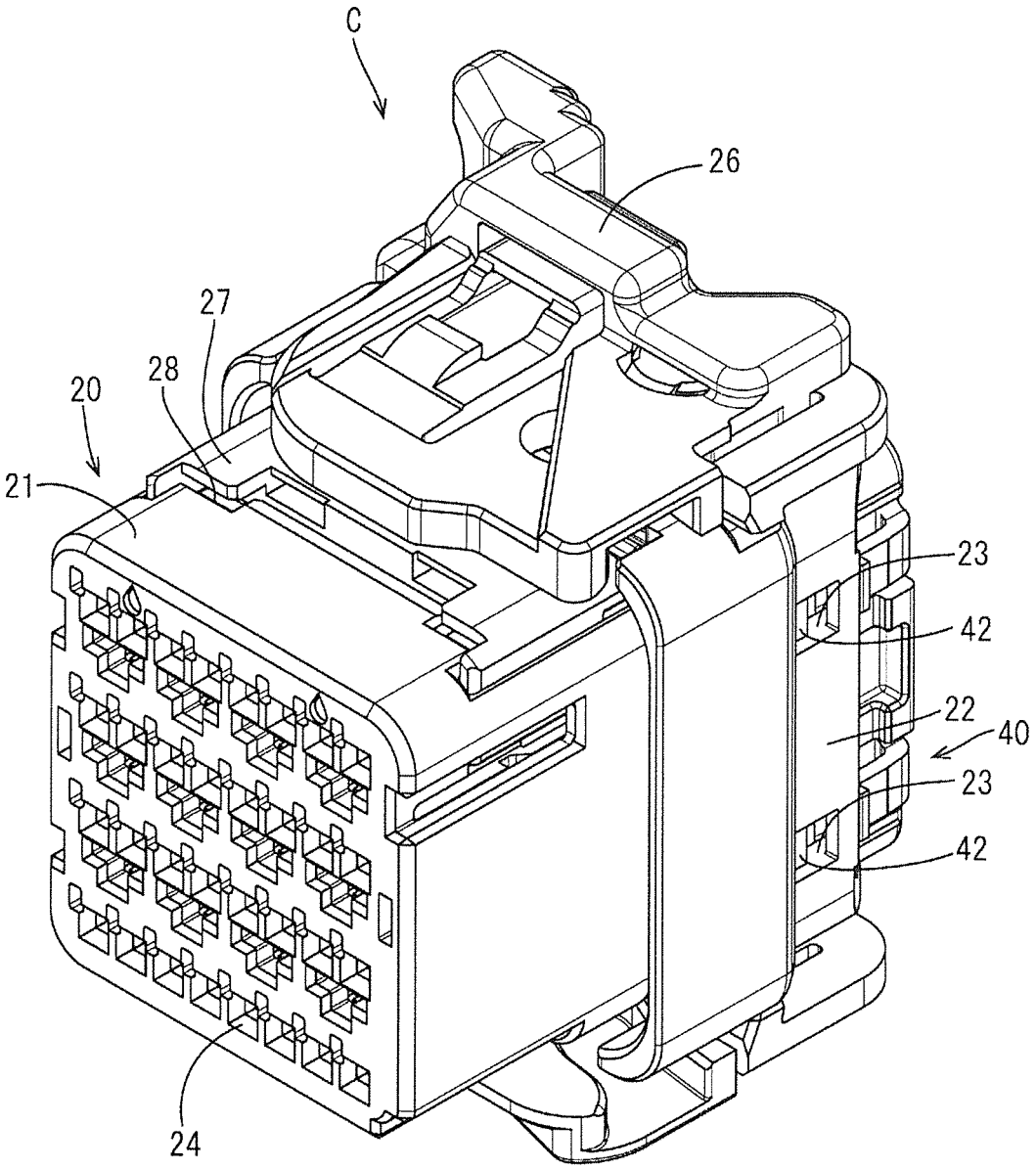
FIG. 1 is a perspective view of a waterproof connector.
Figure 2:
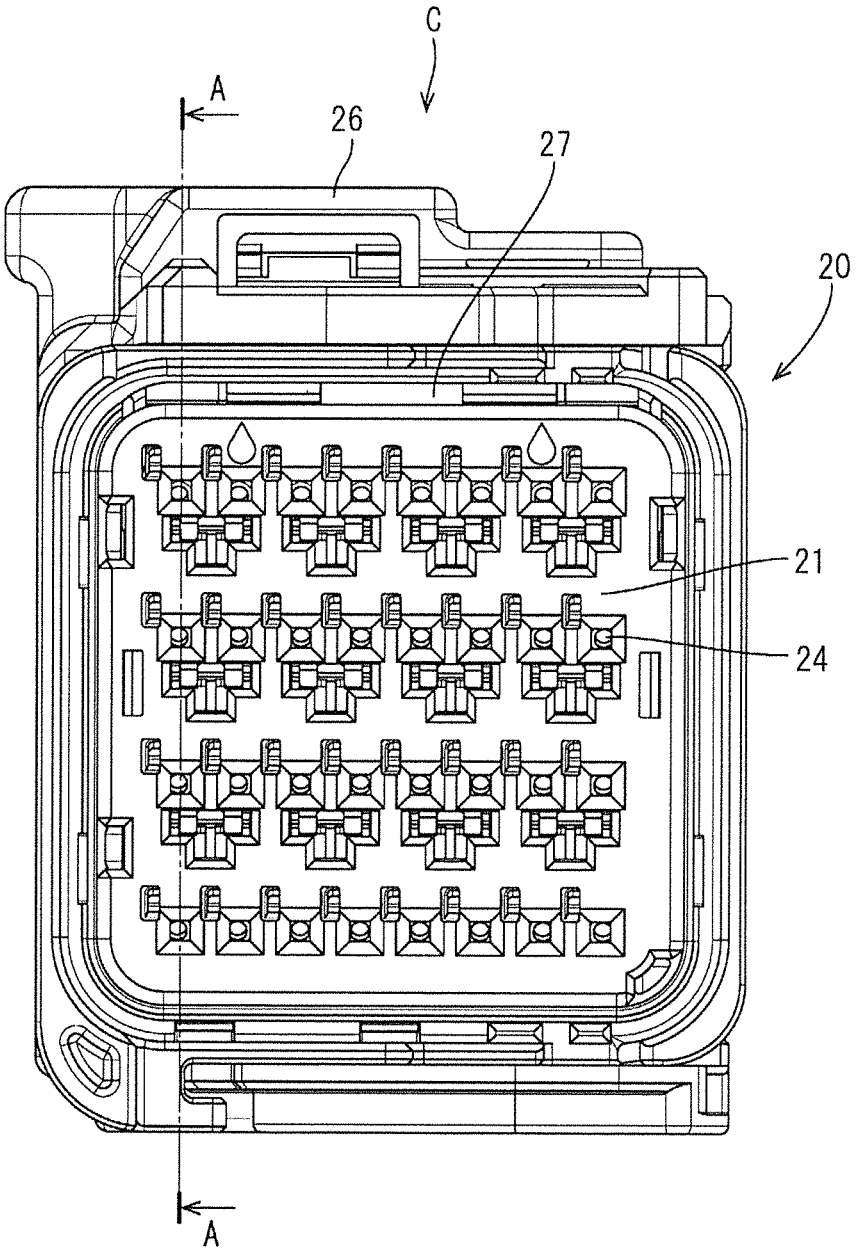
FIG. 2 is a front view of the waterproof connector.
Figure 3:
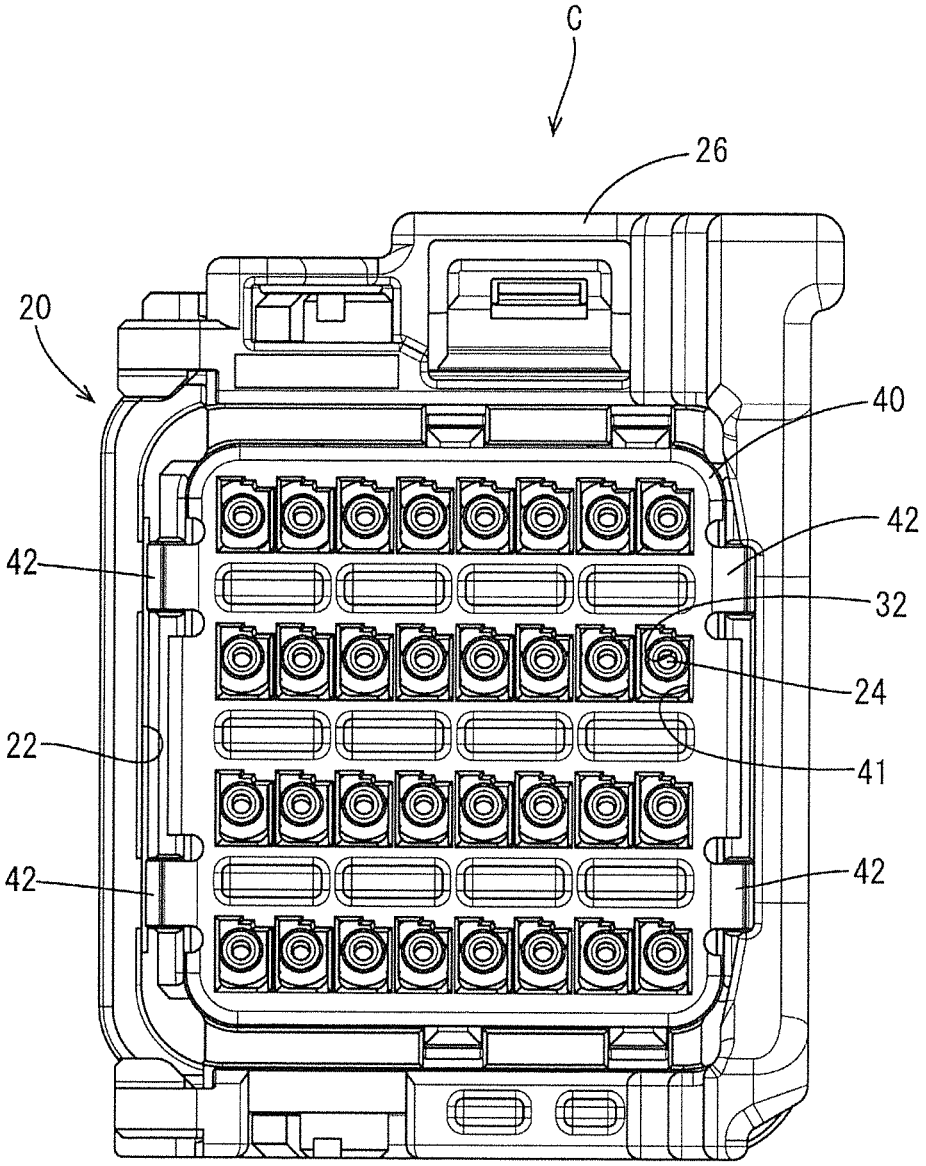
FIG. 3 is a back view of the waterproof connector.
Figure 4:
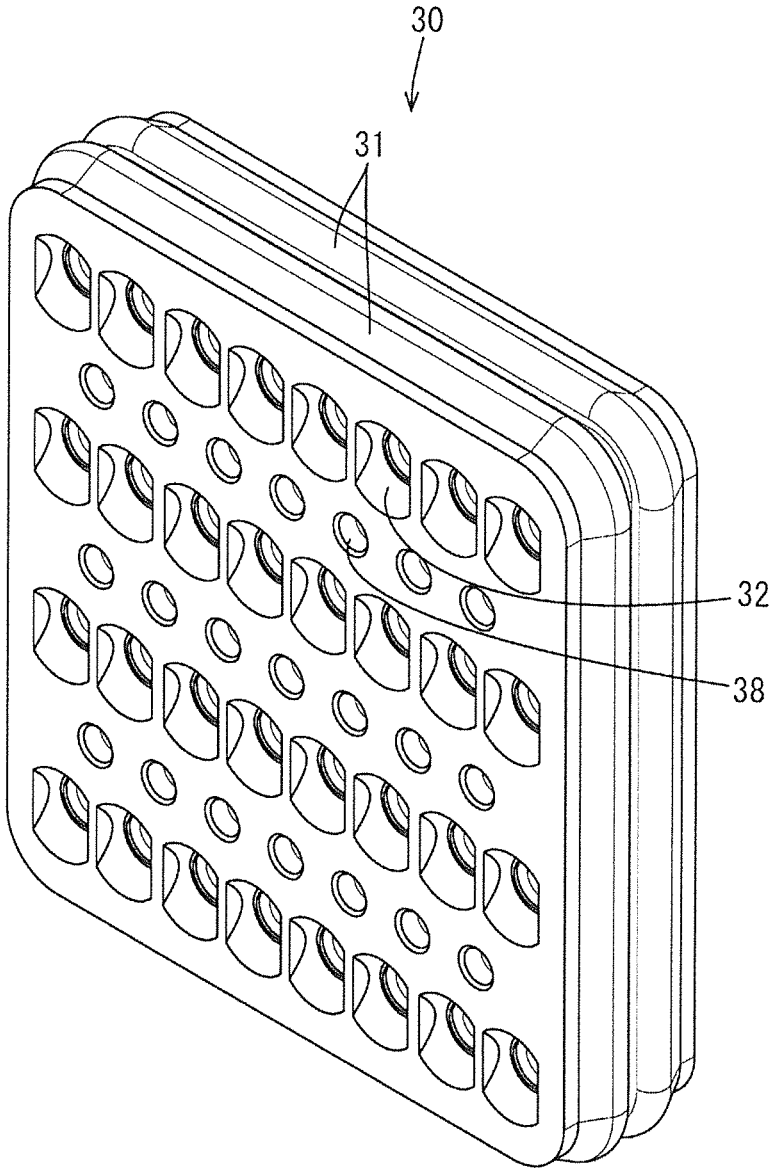
FIG. 4 is a perspective view showing a one-piece rubber plug viewed obliquely from front.
Figure 5:
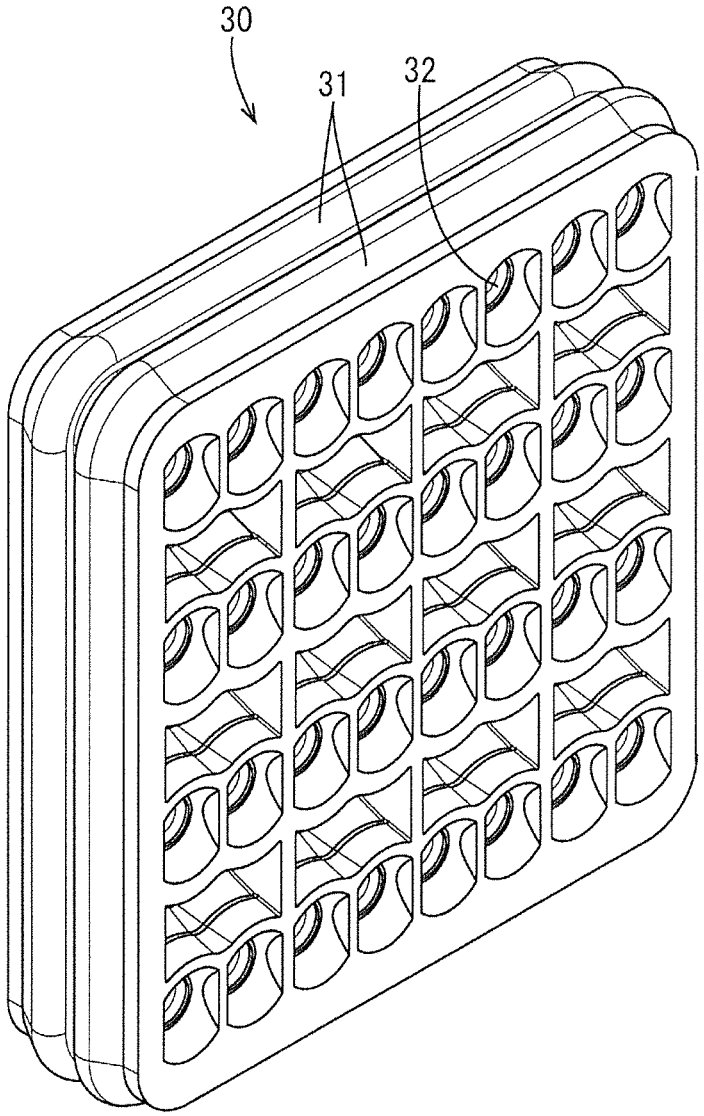
FIG. 5 is a perspective view showing the one-piece rubber plug viewed obliquely from behind.
Figure 6:
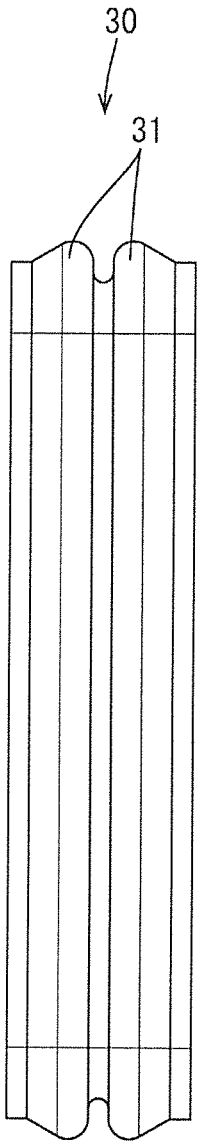
FIG. 6 is a side view of the one-piece rubber plug.
Figure 7:
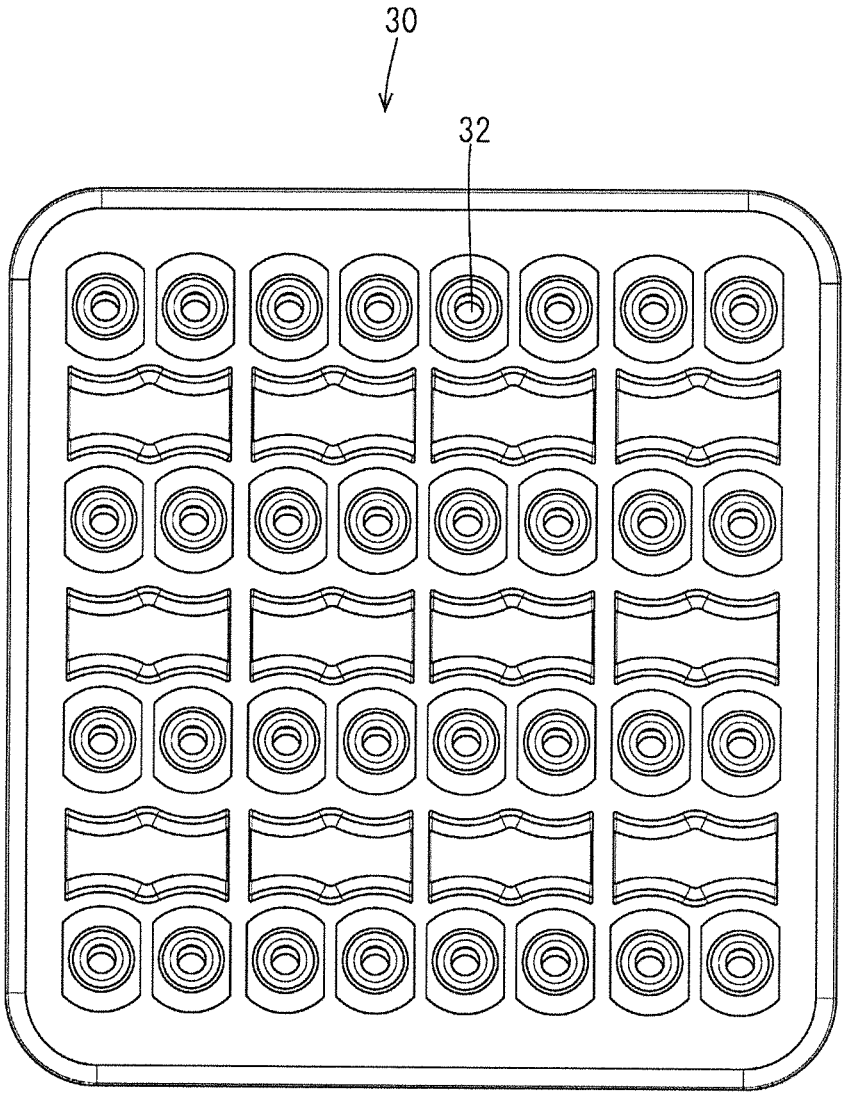
FIG. 7 is a front view of the one-piece rubber plug.
Figure 8:
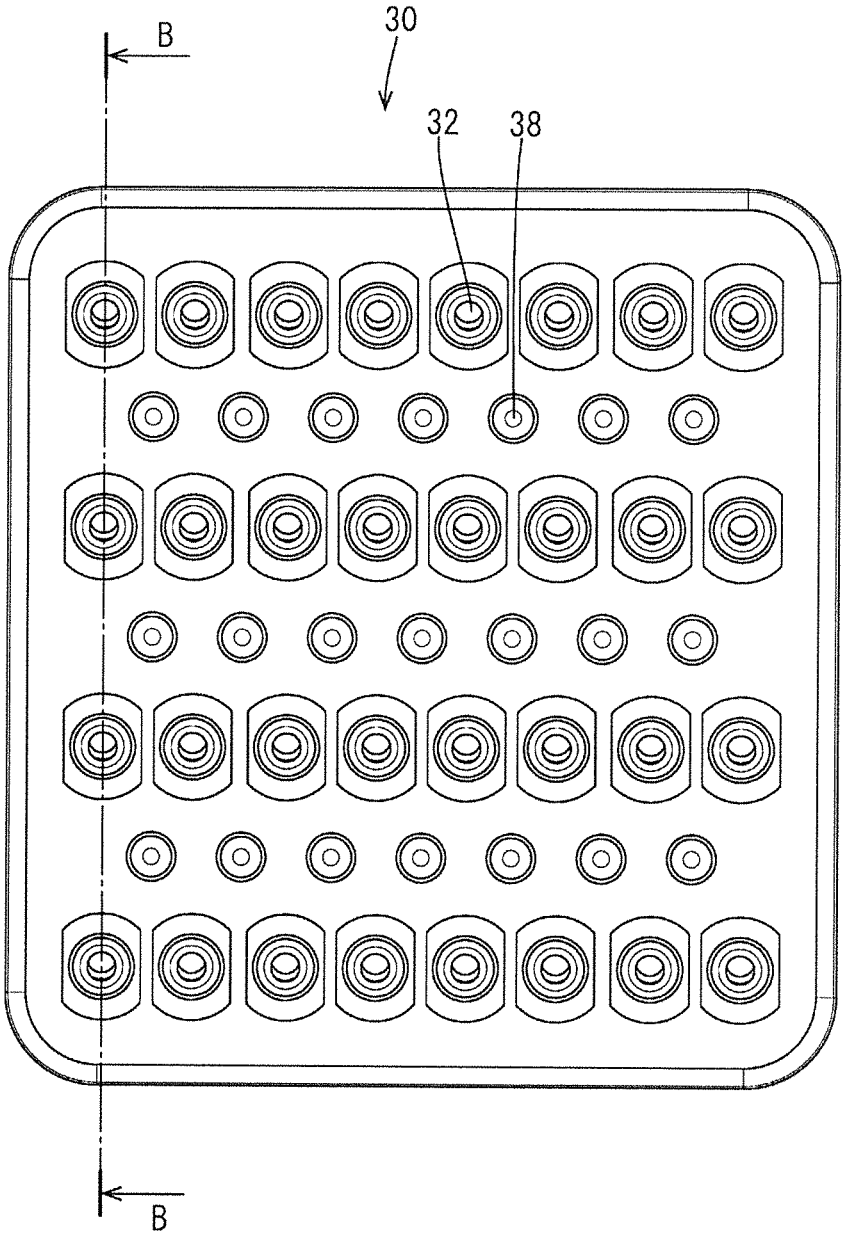
FIG. 8 is a back view of the one-piece rubber plug.

The female housing 20 is made of synthetic resin and is composed of two pieces. As shown in FIGS. 1 to 3, the female housing 20 is in the form of a substantially rectangular block that includes a terminal accommodating portion 21 at a front part and a rearwardly open accommodation recess 22 at a rear part. As described later, the one-piece rubber plug 30 and the rear holder 40 are accommodated into the accommodation recess 22.

The terminal accommodating portion 21 has cavities 24 (eight in this embodiment) oriented in a front-rear direction to accommodate the female terminals 10 crimped to the ends of the wires W. The cavities 24 are formed in alignment in each of four stages. The locking lance 25 to be primarily locked to the locking protrusion 13 of the body 11 of the female terminal 10 is formed at a position near a front end on the upper surface of each cavity 24.

A retainer insertion hole 28 is provided at a position in the terminal accommodating portion 21 behind the locking lances 25 and receives a retainer 27 inserted from above. The retainer 27 is held at a partial locking position for allowing the entrance of the female terminals 10 before the terminal fittings 10 are inserted as shown in FIG. 11, and can be pushed to a full locking position to secondarily lock and retain the female terminals 10 after the female terminals 10 are inserted to proper positions, as shown in FIG. 12

As already described, the accommodation recess 22 into which the one-piece rubber plug 30 and the rear holder 40 are to be accommodated is formed in the rear part of the female housing 20. As shown in FIG. 3, the accommodation recess 22 has a substantially square shape with four rounded corners in a back view. As shown in FIGS. 4 to 8, the one-piece rubber plug 30 is a substantially square thick plate to be fit tightly into a back side of the accommodation recess 22. Two outer peripheral lips 31 are formed on the outer periphery of the one-piece rubber plug 30.

Figure 9:
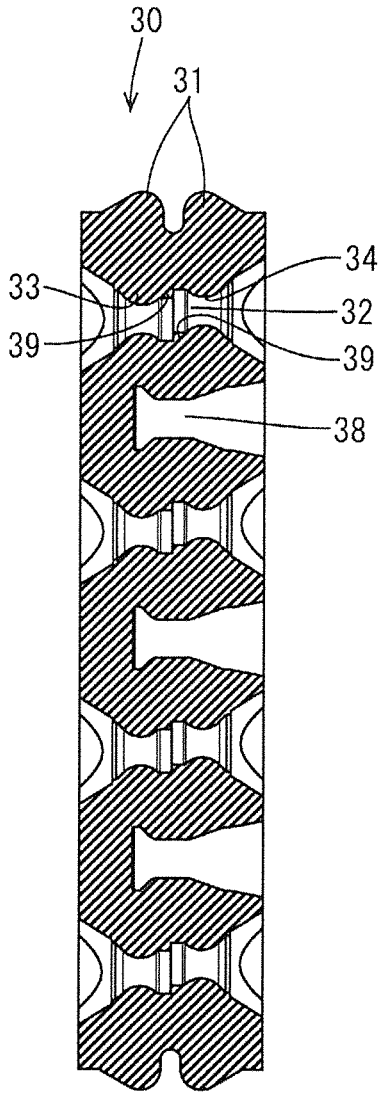
FIG. 9 is a section along B-B in FIG. 8.

Through holes 32 penetrate the one-piece rubber plug 30 in the front-rear direction at positions to align with the respective cavities 24 described above. As shown in FIG. 9, two inner peripheral lips 33, 34 are formed in a central part in a length direction of each through hole 32. The inner peripheral lip located on a front side is referred to as the front inner peripheral lip 33, and the inner peripheral lip located on a rear side is referred to as the rear inner peripheral lip 34 below. Each inner peripheral lip 33, 34 can be held resiliently in close contact with the outer peripheral surface of the inserted wire W. Further, inner diameters (opening diameters) of the respective inner peripheral lips 33, 34 are equal. Inner surfaces of both front and rear end parts of each through hole 32 are inclined to gradually widen toward the front or rear side.

The rear holder 40 is made of synthetic resin and is substantially tightly fittable into an opening side of the accommodation recess 22, as shown in FIG. 12. A total thickness of the above one-piece rubber plug 30 and rear holder 40 overlapping one after the other is equivalent to a depth of the accommodation recess 22. In other words, the one-piece rubber plug 30 and the rear holder 40 are substantially completely fit and accommodated into the accommodation recess 22 while overlapping one after the other.

Insertion holes 41 penetrate the rear holder 40 in the front-rear direction at positions aligned with the respective through holes 32 of the one-piece rubber plug 30 and can receive the female terminals 10 inserted therethrough. Each insertion hole 41 basically has such a cross-sectional shape that the body portion 11 (including the locking protrusion 13 and the stabilizer 14) of the female terminal 10 is insertable therethrough without interfering.

As shown in FIG. 1, upper and lower lock protrusions 42 project on each of both left and right side surfaces of the rear holder 40. Lock holes 23 are formed in left and right side walls of the accommodation recess 22 and the lock protrusions 42 are to be fit and locked in the lock holes 23 when the rear holder 40 is pushed to a proper position where the rear holder 40 overlaps the rear surface of the one-piece rubber plug 30.

Compressing pins 43 are provided on the front surface of the rear holder 40 and are to be press-fit into compressing holes 38 open in a rear part of the one-piece rubber plug 30. The rear holder 40 is assembled with the one-piece rubber plug 30 after all the female terminals 10 are accommodated into the respective cavities 24, and thus the respective compressing pins 43 are press-fit into the respective compressing holes 38 to compress the one-piece rubber plug 30. In this way, the inner peripheral surface of each through hole 32 is pressed strongly against the outer peripheral surface of each wire W to be held in close contact therewith so that high sealing performance is obtained.

Figure 10:
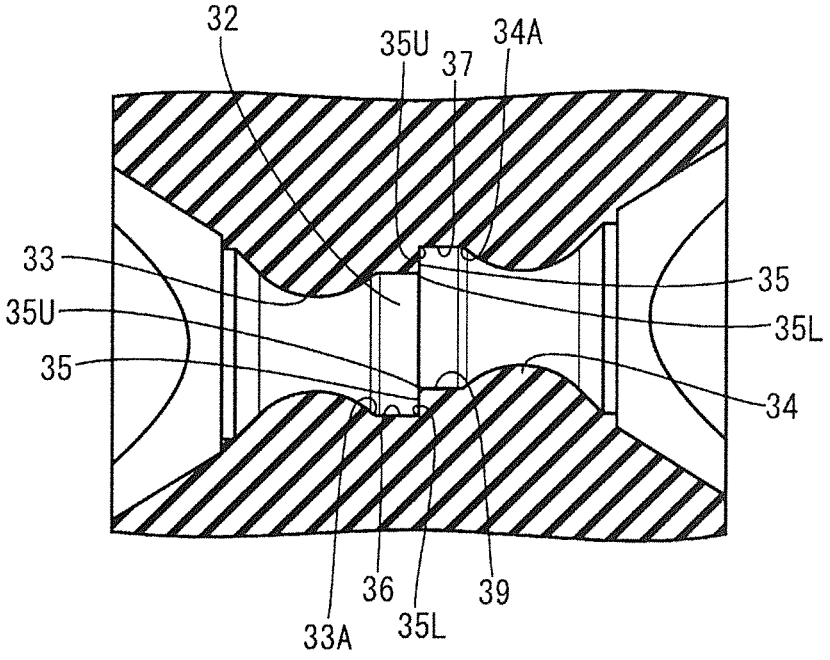
FIG. 10 is a partial enlarged section in FIG. 9.

As shown in FIG. 10, a center of the rear inner peripheral lip 34 of the one-piece rubber plug 30 is displaced up relative to a center of the front inner peripheral lip 33. Upper and lower intermediate lips 39 each having a step 34 are provided between the front and rear inner peripheral lips 33 and 34. The step 35 is configured as a vertical surface extending in a direction perpendicular to an inserting direction of the wire W into the through hole 32.

A front horizontal surface 36 extending rearward toward a lower end 35L of the step 35 and extending in a circumferential direction is provided circumferentially on a rear end 33A of the front inner peripheral lip 33. Further, a rear horizontal surface 37 extending forward toward an upper end 35U of the step 35 and extending in the circumferential direction is provided circumferentially on a front end 34A of the rear inner peripheral lip 34. Furthermore, the front and rear horizontal surfaces 36, 37 are arranged to be parallel to each other and perpendicular to the step 35.

The one-piece rubber plug 30 is molded by front and rear molds that are divided at the positions of the steps 35. Thus, the lower step 35 is formed by a mating surface of the front mold and the upper step 35 is molded by a mating surface of the rear mold. Further, a right-angled corner part is provided at a position of the mating surface of the front mold, and a right-angled corner part is also provided at a position of the mating surface of the rear mold. This can make the molds more difficult to fracture than molds with acute-angled corners at positions of mating surfaces.

Figure 13:
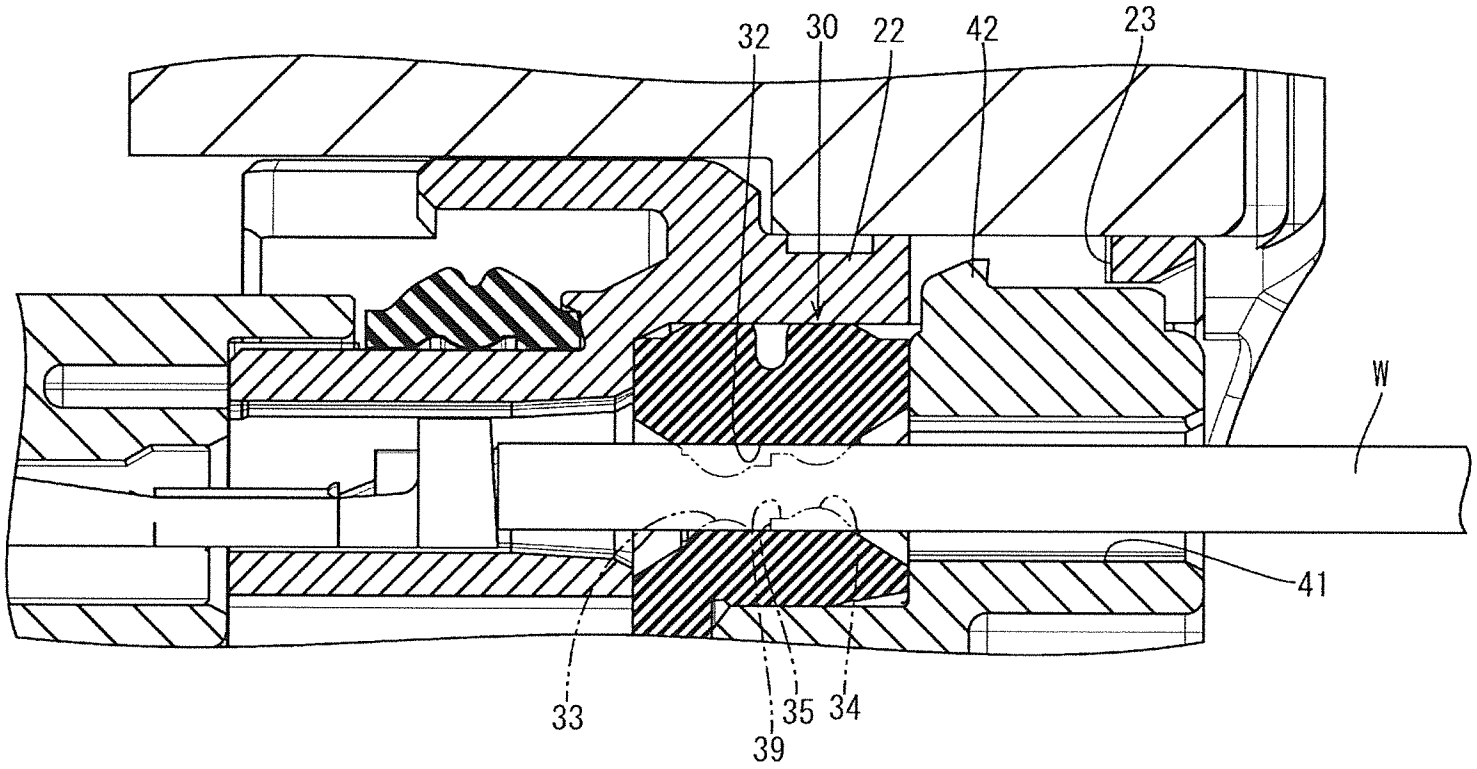
FIG. 13 is a partial enlarged section in FIG. 12.

A vertical dimension of the step 35 matches a deviation amount between the center of the front inner peripheral lip 33 and that of the rear inner peripheral lip 34 (distance between an axial center of the front inner peripheral lip 33 and that of the rear inner peripheral lip 34). That is, the rear inner peripheral lip 34 is disposed at a position displaced up from the front inner peripheral lip 33 by the vertical dimension of the step 35. Further, as shown in FIG. 13, the vertical dimension of the step 35 is set such that the front inner peripheral lip 33, the rear inner peripheral lip 34 and the intermediate lips 39 are held in close contact with the outer peripheral surface of the wire W at a total of three positions with the wire W inserted through the through hole 32.

Figure 14:
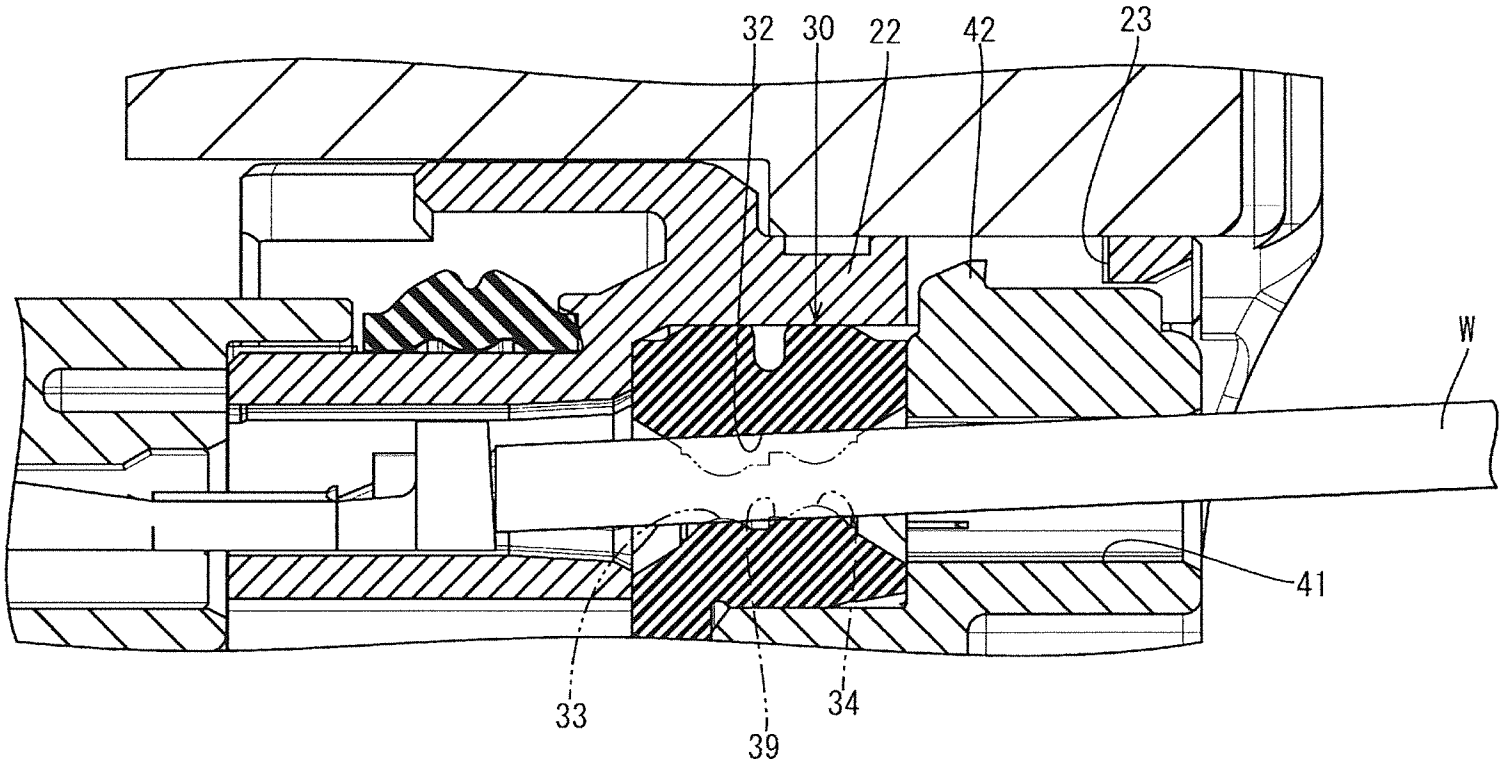
FIG. 14 is a section showing a case where a wire in FIG. 13 is shaken upward.
Figure 15:
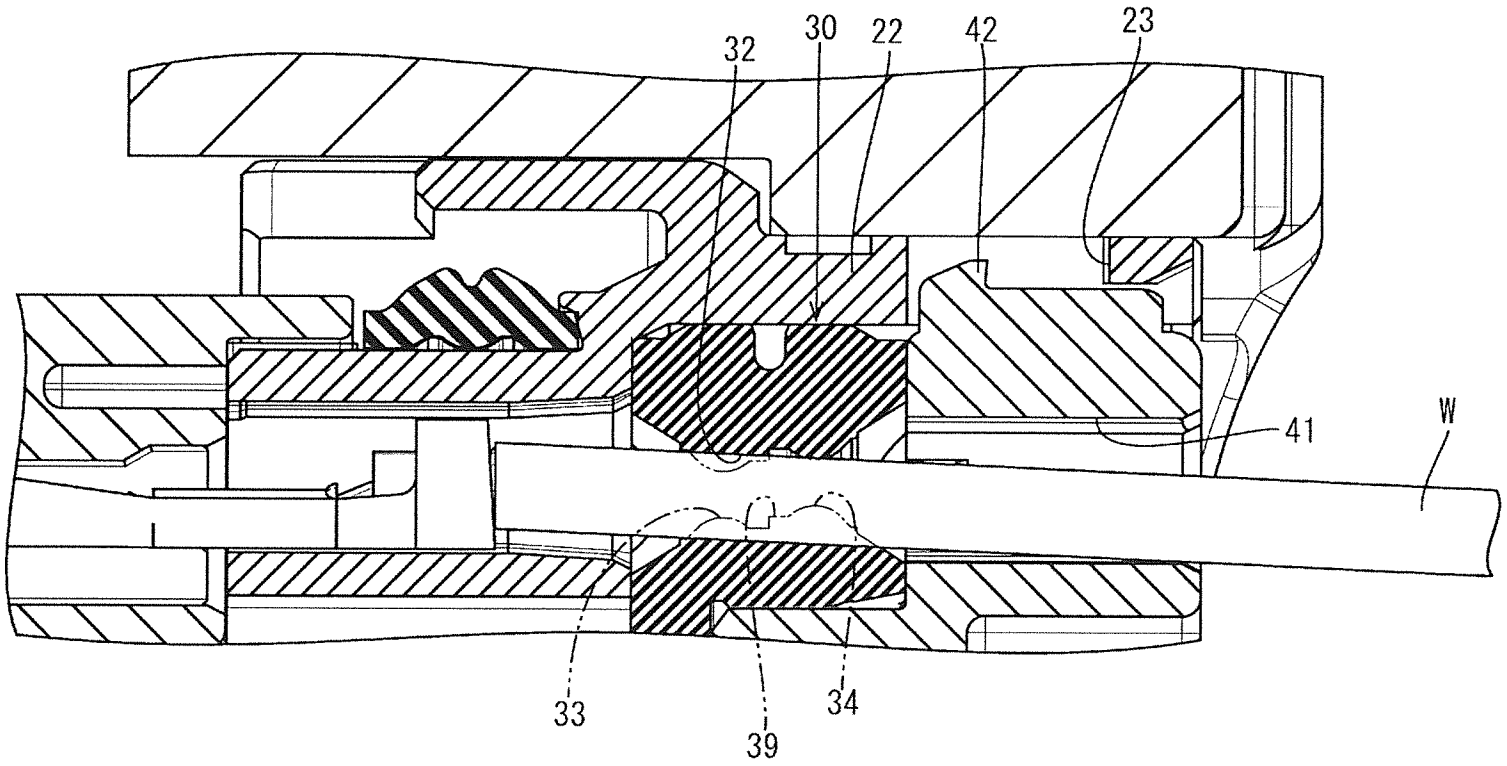
FIG. 15 is a section showing a case where the wire in FIG. 13 is shaken downward.

If the wire W is shaken upward as shown in FIG. 14, a contact force with the outer peripheral surface of the wire W becomes locally weaker at the front inner peripheral lip 33 and the lower step 35, but the rear inner peripheral lip 34 is held in close contact with the outer peripheral surface of the wire W over the entire circumference. Thus, high sealing performance is maintained. On the other hand, if the wire W is shaken downward as shown in FIG. 15, the contact force with the outer peripheral surface of the wire W becomes locally weaker at the rear inner peripheral lip 34 and the upper step 35, but the front inner peripheral lip 33 is held in close contact with the outer peripheral surface of the wire W over the entire circumference. Thus, high sealing performance is maintained.

As described above, even if the wire W is shaken, either one of the front and rear inner peripheral lips 33, 34 certainly is held in close contact with the outer peripheral surface of the wire W. Thus, sealing performance can be exhibited. Specifically, since the inner peripheral lips are provided at positions to be held in close contact with the outer peripheral surface of the wire W if the wire W is shaken, squeezed amounts of the inner peripheral lips by the outer peripheral surface of the wire W are not reduced and sufficient sealing performance is maintained.

The intermediate lips 39 (including the steps 35) may be provided between the front and rear inner peripheral lips 33, 34, and the step 35 may be provided between the front horizontal surface 36 extending rearward from the rear end 33A of the front inner peripheral lip 33 and the rear horizontal surface 37 extending forward from the front end 34A of the rear inner peripheral lip 34. According to this configuration, sealing performance can be exhibited also by the intermediate lips 39. For example, the squeezed amounts of the front and rear inner peripheral lips 33, 34 are possibly rather smaller in a state where the wire W is not shaken than in a state where the wire W is shaken. Also, in that case, sealing performance can be maintained by the intermediate lips 39.

Further, if a center of a front inner peripheral lip and that of a rear inner peripheral lip match, a deepest part of a groove is at positions of mating surfaces and acute-angled corner parts are formed when front and rear molds are divided at the deepest part of the groove located between the front and rear inner peripheral lips. Thus, the molds become easily fractured at the positions of the mating surfaces of the mold. However, according to the above configuration, the intermediate lips 39 including the steps 35 are provided between the front and rear inner peripheral lips 33, 34 and the horizontal surfaces 36, 37 are provided before and after the steps 35. Thus, if the positions of the steps 35 are set on the mating surfaces, corner parts between mold parts for molding the horizontal surfaces 36, 37 and mold parts for molding the steps 35 are substantially right-angled. Therefore, the molds are less likely to be fractured at the positions of the mating surfaces.

The front and rear horizontal surfaces 36, 37 may be parallel to each other and perpendicular to the steps 35. According to this configuration, the corner parts located on the mating surfaces of the molds are right-angled so that fracture of the molds can be prevented more reliably.

The invention is not limited to the above described and illustrated embodiment. For example, the following modes are also included.

Although the front inner peripheral lip 33 and the rear inner peripheral lip 34 whose centers are displaced in the vertical direction are illustrated in the above embodiment, a displacing direction may be a lateral direction without being limited to the vertical direction. In short, if a shaking direction of the wire W is determined in advance, front and rear inner peripheral lips may be arranged to be displaced in the shaking direction of the wire W.

Although the inner diameter of the front inner peripheral lip 33 and that of the rear inner peripheral lip 34 match in the above embodiment, an inner diameter of a front inner peripheral lip and that of a rear inner peripheral lip may be different.

Although the intermediate lips 39 including the steps 35 are provided between the front and rear inner peripheral lips 33, 34 in the above embodiment, the rear end 33A of the front inner peripheral lip 33 and the front end 34A of the rear inner peripheral lip 34 may be coupled in a tapered manner without providing any step.

Although the pair of front and rear molds having the mating surfaces at the positions of the steps 35 are illustrated in the above embodiment, one-piece rubber plugs may be molded by a single mold having no mating surface.

LIST OF REFERENCE SIGNS

10 . . . female terminal
20 . . . female housing
24 . . . cavity
30 . . . one-piece rubber plug
32 . . . through hole
33 . . . front inner peripheral lip
33A . . . rear end
34 . . . rear inner peripheral lip
34A . . . front end
35 . . . step
36 . . . front horizontal surface
37 . . . rear horizontal surface
39 . . . intermediate lip
C . . . waterproof connector
W . . . wire

The invention claimed is:

1. A waterproof connector, comprising:

a wire having a terminal connected thereto;

a housing having opposite front and rear surfaces and being formed with a cavity extending from the rear surface to the front surfaces, the cavity being capable of accommodating the terminal; and a rubber plug having opposite front and rear surfaces and being formed with a through hole in correspondence with the cavity, the front surface of the rubber plug being disposed on the rear surface of the housing, the wire being inserted through the through hole;

wherein the through hole has an inner peripheral surface formed with front and rear inner peripheral lips to be held in close contact with an outer peripheral surface of the wire, the front inner peripheral lip being generated about a front center axis extending parallel to a front-rear direction and the rear inner peripheral lip being generated about a rear center axis extending parallel to the front-rear direction, the front and rear center axes being displaced from one another in a direction intersecting the front-rear direction.

2. A waterproof connector, comprising:

a wire having a terminal connected thereto;

a housing formed with a cavity capable of accommodating the terminal; and a rubber plug formed with a through hole in correspondence with the cavity and disposed on a rear surface of the housing;

wherein the rubber plug includes the through hole, the wire being inserted through the through hole, a pair of front and rear inner peripheral lips to be held in close contact with an outer peripheral surface of the wire are provided on an inner wall of the through hole, and a center of the front inner peripheral lip and a center of the rear inner peripheral lip are displaced in a direction intersecting an inserting direction of the wire; and wherein an intermediate lip including a step is provided between the front and rear inner peripheral lips, and the step is provided between a front horizontal surface extending rearward from a rear end of the front inner peripheral lip and a rear horizontal surface extending forward from a front end of the rear inner peripheral lip.

3. The waterproof connector of claim 2, wherein the front and rear horizontal surfaces are arranged to be parallel to each other and perpendicular to the step.

4. A waterproof connector, comprising:

a wire having a terminal connected thereto;

a housing having opposite front and rear surfaces and being formed with a cavity extending from the rear surface to the front surfaces, the cavity being capable of accommodating the terminal; and a rubber plug having opposite front and rear surfaces spaced apart in a front-rear direction and being formed with a through hole in correspondence with the cavity, the front surface of the rubber plug being disposed on the rear surface of the housing, the wire being inserted through the through hole;

wherein the through hole has an inner peripheral surface formed with front and rear inner peripheral lips having substantially identical circumferences selected so that innermost parts of the front and rear inner peripheral lips can be held in close contact with an outer peripheral surface of the wire, the entire front inner peripheral lip being displaced from the entire rear inner peripheral lip in a direction intersecting the front-rear direction.

* * * * *